US005873793A

United States Patent [19]

Swinford

[11] Patent Number: 5,873,793

[45] Date of Patent: Feb. 23, 1999

[54] GOLF CLUB AND ASSOCIATED MANUFACTURING METHOD

[76] Inventor: Mark D. Swinford, 1001 Marycrest La., Centerville, Ohio 45429

[21] Appl. No.: 997,579

[22] Filed: Dec. 23, 1997

[51] Int. Cl.[6] ..... A63B 53/10; A63B 53/12

[52] U.S. Cl. ..... 473/317; 473/320

[58] Field of Search ..... 473/316–323, 473/296, 298, 299

[56] References Cited

U.S. PATENT DOCUMENTS

| | | | |
|---|---|---|---|
| 1,239,356 | 9/1917 | Cochrane et al. | 273/80 |
| 1,396,470 | 11/1921 | Taylor | 273/77 |
| 1,528,017 | 3/1925 | Gammeter | 273/80 |
| 1,994,069 | 3/1935 | Fletcher | 273/80 |
| 2,018,723 | 10/1935 | Hutchison | 273/80 |
| 2,027,635 | 1/1936 | Cunningham | 273/80 |
| 2,153,550 | 4/1939 | Cowdery | 273/80 |
| 3,461,593 | 8/1969 | Martuch | 473/318 |
| 4,132,579 | 1/1979 | VanAuken | 273/DIG. 23 |
| 4,809,983 | 3/1989 | Langert | 273/167 |
| 5,120,061 | 6/1992 | Tsuchida et al. | 273/167 |
| 5,335,908 | 8/1994 | Bamber | 273/80 |
| 5,545,094 | 8/1996 | Hsu | 273/80 |
| 5,575,725 | 11/1996 | Olsavky | 273/167 |
| 5,599,242 | 2/1997 | Solviche et al. | 273/80 |
| 5,626,529 | 5/1997 | Roy | 273/80 |
| 5,632,692 | 5/1997 | Lebovici | 273/80 |
| 5,634,860 | 6/1997 | McIntosh et al. | 273/80 |

OTHER PUBLICATIONS

Hollman, Martin, "Composite Aircraft Design," Monterey, CA C1993, pp.21,25.

McCormick, Barnes W., "Aerodynamics, Aeronautics, and Flight Mechanics," John Wiley and Sons, New York, NY, C1979, Ch. 4, pp. 162–181.

Design News, "Ansys," (advertisement) 17 Feb. 1997.

Allen, "Introduction to Aerospace Structural Analysis", John Wiley and Sons, New York, NY, C1985 Chapter 4 pp. 160–181, 1985.

*Primary Examiner*—Steven Wong
*Assistant Examiner*—Stephen L. Blau

[57] ABSTRACT

A golf club shaft having a spar, a tube, and a skin is formed which reduces shaft aerodynamic drag. The skin transforms in cross-sectional shape from a circular one at the grip, to a streamlined shape at the shaft tip. The spar introduces stiffness in the plane generally perpendicular to the direction of swing, thereby offsetting the effect of unequal sectional moments of inertia of the streamlined skin. Manufacturing methods are also disclosed.

16 Claims, 5 Drawing Sheets

GOLF CLUB AND ASSOCIATED MANUFACTURING METHOD

CROSS REFERENCE TO RELATED APPLICATIONS

Not applicable

STATEMENT REGARDING FEDERALLY SPONSORED R&D

Not applicable

REFERENCE TO A MICROFICHE APPENDIX

Not applicable

FIELD OF THE INVENTION

The present invention relates to golf club shafts, and more particularly to shafts with reduced aerodynamic drag.

BACKGROUND OF THE INVENTION

It is well known that the distance traveled by a golf ball following impact with a golf club driver is directly related to clubhead speed. Various methods have been devised to reduce the overall aerodynamic drag of golf clubs in order to increase clubhead speed. All share a common denominator which is making the components of a golf club more aerodynamically shaped.

With regard to the golf club shaft, the drag coefficient of a shaft with a circular cross-section is as much as 25 times greater than that for a shaft with a streamlined cross-section, for equal cross-sectional heights. As early as 1921, attempts have been made to make the shaft more aerodynamic, as evident in prior U.S. Pat. Nos. 1,396,470 to Taylor, and 1,528,017 to Gammeter.

Despite these and other efforts, all current United States Golf Association (USGA) legal shafts on the market today have circular cross-sections, largely due to the constraints of USGA regulation 4-1b which specifies that at any point along its length the shaft shall:

(i) Bend in such a way that the deflection is the same regardless of how the shaft is rotated about its longitudinal axis.

(ii) Twist the same amount in both directions.

Additionally, regulation 4-1c specifies:

(i) For clubs other than putters the grip must be circular in cross-section . . .

A shaft employing a circular cross-sectional shape is symmetric about any axis orthogonal to the shaft's longitudinal axis, and thus offers equal bending and twisting properties regardless of orientation around the longitudinal axis. Such a shaft is readily manufactured in various fashions, including drawn metallic tubing and filament wound composites. Moreover, symmetrical shapes such as squares might be employed if the drag coefficient was not even greater than that of a circular shape. The limiting factors which have in the past prevented the introduction of a shaft with a streamlined cross-section, satisfying USGA regulations, are materials and manufacturing methods. Recently however, advances in these areas and in the area of computer aided design/manufacturing/engineering (CAD/CAM/CAE) now allow for such a shape.

It can be readily imagined by those skilled in the art a shaft whose external shape is more aerodynamic than that of a shaft with a circular cross-section. More difficult to imagine is the internal structure which will allow for this shape.

Prior U.S. Pat. No. 5,335,908 to Bamber (1994) broadly suggests an elliptical shape to reduce drag. This patent proposes to fixate a compressible and resilient sheath around a circular shaft, install a "truss structure" within the interior of the shaft, or vary the wall thickness of the shaft. The disadvantages with these methods which limit practicality are:

1. A sheath which offers high compressibility, and thus does not alter the bending characteristics of the circular shaft, probably embodies low resiliency. This sheath would be of low durability.
2. In order to use an industry standard grip, the shaft's exterior shape must transform from an elliptical shape to a circular shape. This shape transformation requires a non-abrupt transformation of the truss structure to preserve equal bending characteristics of the shaft. The shape of this transformed truss structure is not disclosed, and is envisioned to be virtually impossible to manufacture.
3. Varying the wall thickness at a given cross-section of the shaft is considered to be difficult in a conventional filament winding process or steel tube drawing process.

U.S. Pat. Nos. 2,018,723 to Hutchison (1935), and 5,632,692 to Lebovici (1997), suggest golf shafts with generally triangular cross-sectional shapes orientated to present the tapered leading edge to the flow of air, with the object of reducing drag. These proposals would offer minimal reductions in shaft drag, and may increase drag due to separated airflow aft of the maximum cross-sectional height. In fact, for Reynolds numbers of up to two million, a two dimensional triangular shape has a drag coefficient of 1.3, as compared to a drag coefficient of 1.0 for a circular shape (McCormick).

McCormick states that a 2-D streamlined shape with a fineness ratio of 3.0 produces a minimum profile drag coefficient, where fineness ratio is the body width aligned with the flow of air divided by the body height. Thus, neglecting structural considerations, a streamlined golf club shaft should have a width to height ratio on the order of 3.0 to minimize drag. The previously mentioned prior art underestimate the importance of an after-body on the reduction of drag, and suggest shapes which abruptly end after the point of maximum cross-sectional height.

Although the referenced prior art address the goal of reducing shaft drag, as of this invention's filing a streamlined shaft which meets USGA regulations is not commercially available. There still exists a need for an aerodynamic golf shaft which promotes an increased clubhead speed, whose exterior is durable in nature, and which meets the USGA regulations with regard to bending and twisting.

SUMMARY OF THE INVENTION

The present invention relates to a golf club shaft with a streamlined cross-section beginning at the tip of the shaft and extending toward the grip for a predetermined distance. This streamlined shape may take the form of a symmetrical diamond-like airfoil, or in the preferred embodiment, an approximated symmetrical NACA (forerunner to NASA) airfoil.

In order to satisfy the previously mentioned USGA regulations, a spar is oriented within a skin such that bending characteristics about the streamlined axis and the axis normal to the streamlined axis are substantially equalized. For the greater portion of its length, this spar has a cross-section resembling the I-beam like cap strip and web construction of an aircraft spar. At the spar end nearest the grip, a transformation to a circular cross-sectional shape occurs. This transformation is necessary to allow a transformation in cross-sectional shape of the skin from a streamlined shape to a circular shape. In this transformation region, equal bending properties of the shaft about the previously described axes are maintained by equalizing the sectional properties of the spar and skin combination.

Manufacturing the shaft may require a conventional filament winding process in the region between the grip and the beginning of the spar, and a process of filament winding about a core in the region where the shaft's cross-sectional shape is non-circular. A fibrous material with a resin binder may be wrapped around a temporary mandrel and around the end of the spar which is fully circular in section, forming a tube. Alternately, a conventional drawn metallic tube is attached to the circular end of the spar. A fibrous material with a resin binder is then wrapped around the tube and extends to the tip of the shaft, forming a skin. This skin transforms from a circular cross-sectional shape to streamlined shape. The core material is required to provide shape during filament winding of the portion of the skin which is streamlined in shape, and also aids in the prevention of skin buckling. The core is divided into two portions, each portion on opposite sides of the I-beam shaped spar.

The streamlined portion of the shaft reduces drag along the region of the shaft which is travelling at a relative maximum speed, and thus reduces the swinging torque for a given speed over a conventional shaft. The streamlined shaft also allows further refinement of the hosel portion of the clubhead to a more aerodynamic shape. The benefit of the present invention is to permit an increased clubhead speed over a conventional shaft, and thus promote a longer drive of a golf ball. The invention is particularly suited for golf clubs commonly called "woods", due to the use of such for initial long range shots. However, this invention may be applied equally to golf clubs commonly referred to as "irons", especially those with low numerical designations, such as a "two iron".

REFERENCE NUMERALS IN DRAWINGS

10 Golf Club
12 Clubhead
14 Grip
16 Shaft
18 Club Face
20 Clubhead Body
22 Hosel
23 Recessed Surface
24 Sole
25 Web
26 Spar
27 Cavity
28 Skin
29 Leading edge
30 Tube
31 Trailing Edge
32 Core
33 Tapered Annular Surface
34 Filler Material
36 Thin Film

DETAILED DESCRIPTION OF THE INVENTION

Figure 1:
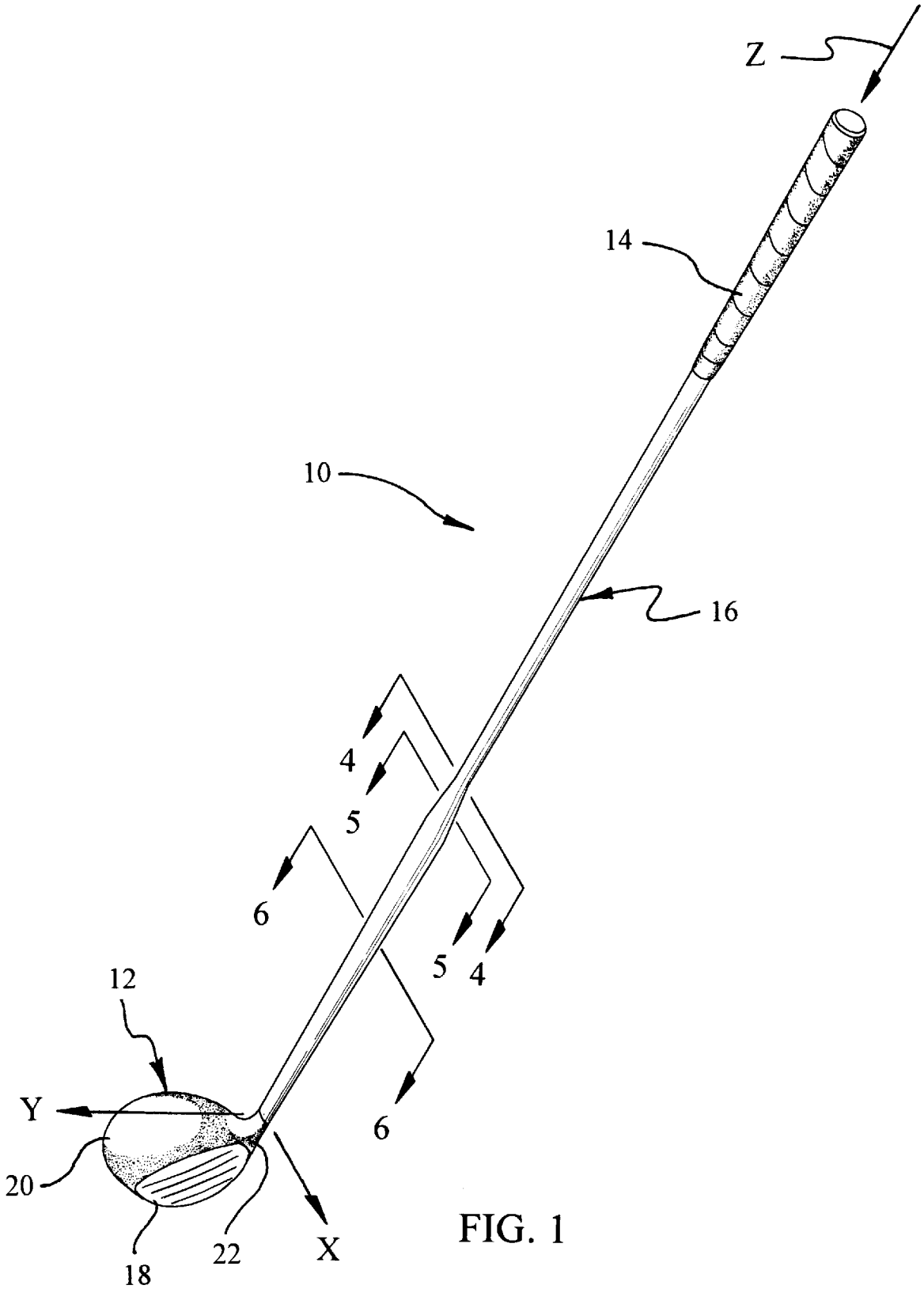
FIG. 1 is a perspective view of the golf club constructed in accordance with the embodiment of the present invention.

FIG. 1 is a perspective view of a golf club of the present invention which embodies a streamlined shaft. The golf club 10 has a clubhead 12, a grip 14, and a shaft 16. For the purpose of describing the orientations and structural properties of the components of the present invention, three (3) axes are defined, a longitudinal or Z axis directed from the grip 14 to the clubhead 12, an X axis directed generally in the swing direction and perpendicular to the Z axis, and a Y axis generally perpendicular to the swing direction (X axis) and the Z axis. The greater dimension of the shaft 16 is aligned with the previously defined longitudinal axis. The shaft 16 is of conventional shape form the grip 14 up to a predetermined distance before the tip of the shaft 16.

Figure 2:
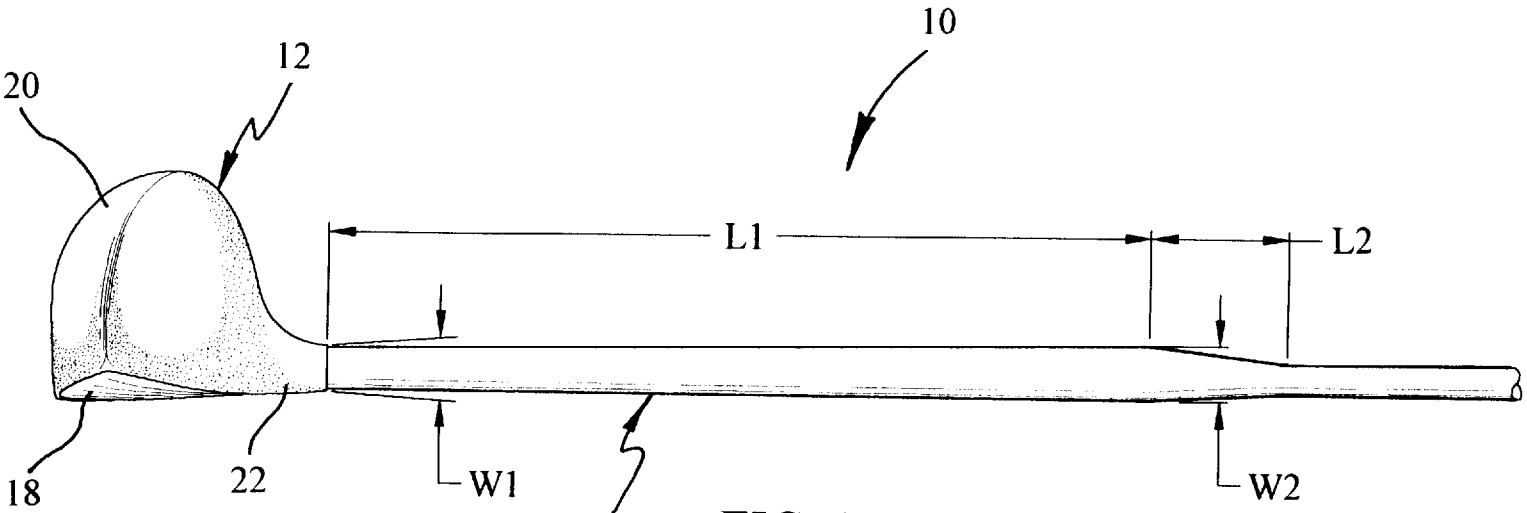
FIG. 2 is a partial top view of the golf club of the present invention.
Figure 3:
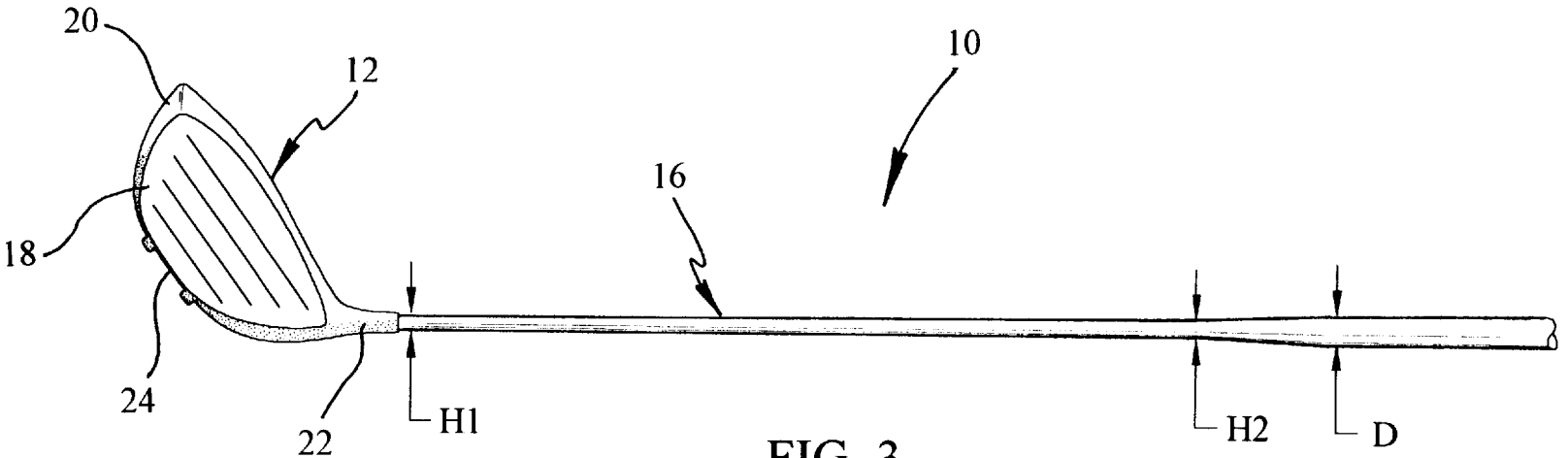
FIG. 3 is a partial front view of the golf club of the present invention.

FIGS. 2 and 3 are partial top and front views respectively of the present invention. The clubhead 12 has a club face 18, a clubhead body 20, a hosel 22, and a sole 24. The shaft 16 embodies a streamlined shape for a predetermined distance L1, which preferably ranges between 10 and 60 cm. This portion is followed by a transitional region of length L2, which may range between 5 and 25 cm. The transitional region allows a transition in external cross-sectional shape of the shaft 16 from streamlined to circular, while maintaining equal bending properties about the X and Y axes. The tip of the shaft 16 has a predetermined width W1, preferably in the range of 1.25 to 2.05 cm, and height H1, preferably between 0.45 and 0.80 cm. In the preferred embodiment, the streamlined portion of the shaft 16 tapers slightly over the length L1, in order to gradually increase stiffness of the shaft 16. At a distance L1 from the hosel 22, a predetermined width W2 ranges between 1.50 to 3.20 cm, and height H2 ranges between 0.52 to 1.12 cm. At a predetermined distance of L1+L2 from the hosel 22, the diameter D is approximately equal to that for a conventional shaft at a similar distance from its respective hosel, ranging between 0.9 to 1.8 cm. FIGS. 2 and 3 depict the invention without twist of the streamlined portion of shaft 16. However, due to the complex swinging motion of a golf club, twist may be incorporated into the shaft 16 in order to optimize the angle of attack of the streamlined shape with respect to the air-stream.

These previously mentioned measurements may vary from the preferred embodiment however, the primary objective of the present invention is to minimize shaft drag for a practical distance (L1) from the tip of the shaft 16. This practical distance is limited by the diminishing sectional drag and corresponding torque for sections of the shaft 16 nearest to the grip 14. Additionally, the weight of the shaft 16 may increase as the streamlined region increases in length. Further, dimensions W1, W2, H1, and H2 are compromises between the desire for a shaft with a thin streamlined section, and the necessity for shaft cross-sectional height for restitution of bending stiffness about the X axis.

Figure 4:
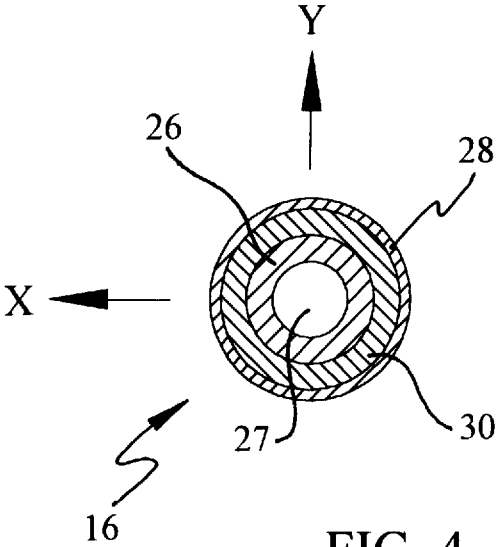
FIG. 4 is a cross-sectional view of the golf club of the present invention taken along cutting plane 4—4 of FIG. 1.

FIG. 4 is a cross-sectional view of the shaft 16 taken along cutting plane 4—4 of FIG. 1. In this region, the shaft 16 has a spar 26, a skin 28, and a tube 30, each having circular cross-sections. The tube 30 ends at the beginning of the transitional region of the shaft (L1+L2 from the hosel 22, FIG. 2). In this vicinity, the spar 26 and skin 28 are separated from on another by the interior and exterior surfaces of the tube 30. Additionally, the interior portion of the spar 26 preferably defines a cavity 27 with a circular cross-section.

Figure 5:
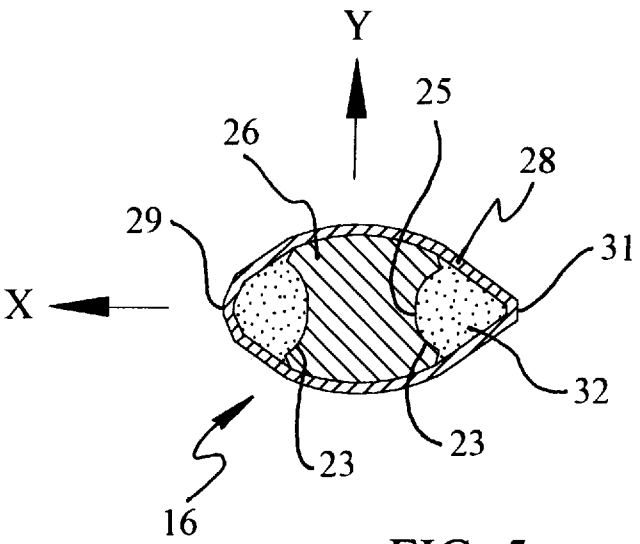
FIG. 5 is a cross-sectional view of the golf club of the present invention taken along cutting plane 5—5 of FIG. 1.

FIG. 5 is a cross-sectional view of the shaft 16 taken along cutting plane 5—5 of FIG. 1. This sectional view represents the shaft 16 as it has midway transitioned from a circular shape to a fully streamlined shape. The shaft 16 embodies a leading edge 29 and a trailing edge 31. In this vicinity, the skin 28 is in direct contact with a portion of the spar 26 and a core 32. The core 32 provides shape during filament winding of the skin 28. The core 32 is divided into two parts within the interior of the skin 28 , a first portion in the region of the leading edge 29 of the shaft 16, and a second portion in the region of the trailing edge 31. Division of the two portions of the core 32 is due to the web of the spar 26.

The spar 26 depicted in FIG. 5 is midway transitioned from a circular cross-sectional shape to an I-beam like shape. The spar 26 may have a recessed surface 23 generally mirrored about the Y axis of the cross-section, forming a web 25. In this vicinity, the spar 26 introduces a slightly greater moment of inertia about the X axis than about the Y axis, due to the recessed surfaces 23. This is necessary to counteract the skin 28 which has slightly greater moment of inertia properties about the Y axis than about the X axis.

Figure 6B:
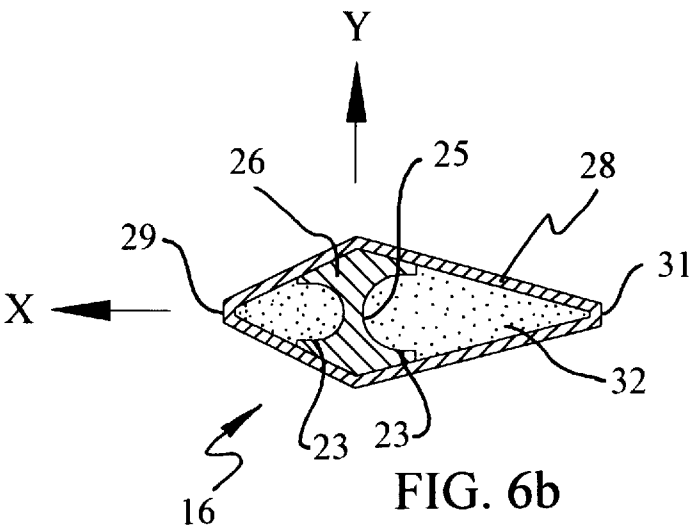
FIG. 6*b* is a cross-sectional view of the alternate embodiment of the golf club of the present invention taken along cutting plane 6—6 of FIG. 1.
Figure 6A:
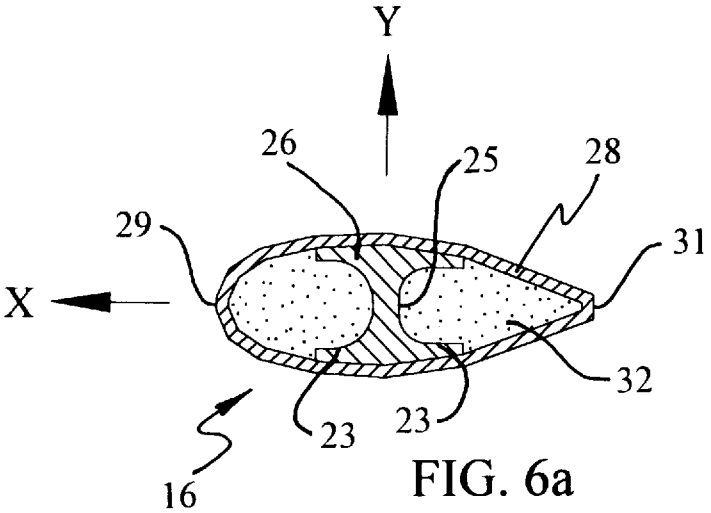
FIG. 6*a* is a cross-sectional view of the preferred embodiment of the golf club of the present invention taken along cutting plane 6—6 of FIG. 1.

FIG. 6*a* is a cross-sectional view of the shaft 16 taken along cutting plane 6—6 of FIG. 1. In this preferred embodiment, the shaft's cross-sectional shape is an approximated airfoil composed of many facet-like edges. This shape is similar to a NACA 0030 airfoil, which is a symmetrical airfoil with a height 30% of its streamlined width or chord. The present invention has a streamlined shape with a slightly greater height of approximately 35% of its chord, due to structural considerations.

FIG. 6*b* depicts an alternate embodiment of the present invention. In this embodiment the shaft's cross-sectional shape is an approximated airfoil with exactly six (6) facet-like edges, forming a diamond-like shape.

The shaft 16 depicted in FIGS. 6*a* and 6*b* has a cross-section which has fully transitioned to a streamlined shape. The leading and trailing edges of the preferred and alternate embodiments are perpendicular to the X axis. The facet-like shapes offer reduced machining complexity of the core 32 and spar 26 prior to filament winding of the skin 28. The desire for a minimal number of facets is balanced with the desire for the lower drag characteristics of an infinitely faceted streamlined shape.

The spar 26 depicted in FIGS. 6*a* and 6*b* is fully transitioned to an I-beam like cross-sectional shape such that the spar has a stiffness greater about an axis generally aligned with a direction of swing (X axis) than about an axis generally perpendicular to the direction of swing (Y axis). The spar 26 embodies greater moment of inertia properties about the X axis than about the Y axis. The ratio of the spar's X axis moment of inertia to Y axis moment of inertia may range between 1.3 to 2.8. The value is dependent on the longitudinal Young's modulus of the material used for both the spar 26 and the skin 28, and the skin's moment of inertia about X and Y axes. It is preferable to position the neutral Y axis of the spar 26 in line with the neutral Y axis of the skin 28, in order to minimize twisting of the shaft 16 when bending.

Figure 7:
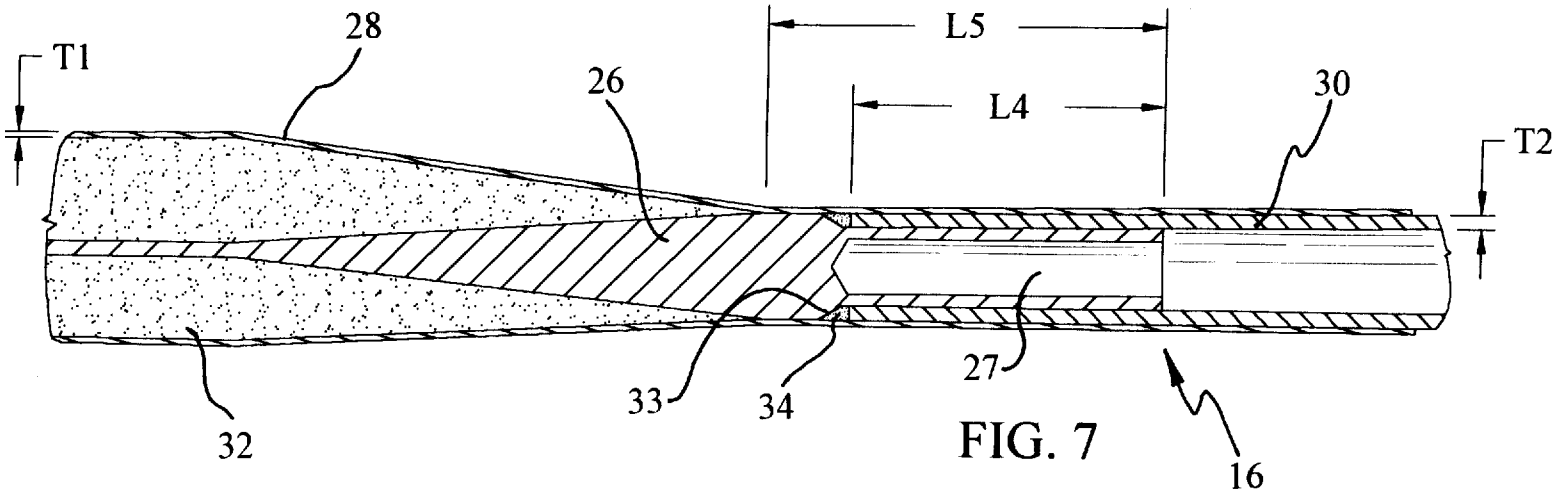
FIG. 7 is a partial cross-sectional view of the golf club of the present invention in the transitional region of the shaft, taken along a plane defined by the Z and X axes of FIG. 1.

FIG. 7 is a partial cross-sectional view of the shaft 16 in the transitional region, taken along a plane defined by the Z and X axes of FIG. 1. The viewing plane cuts through the vertical web of the I-beam like spar 26. The core 2 diminishes at the portion of the shaft 16 (L1+L2 from the hosel 22, FIG. 2) where the spar 26 has a circular cross-section. The thickness T1 of the skin 28 may range from 0.25 to 1.00 mm. The thickness T2 of the tube 30 may range from 0.45 to 1.75 mm.

Figure 8:
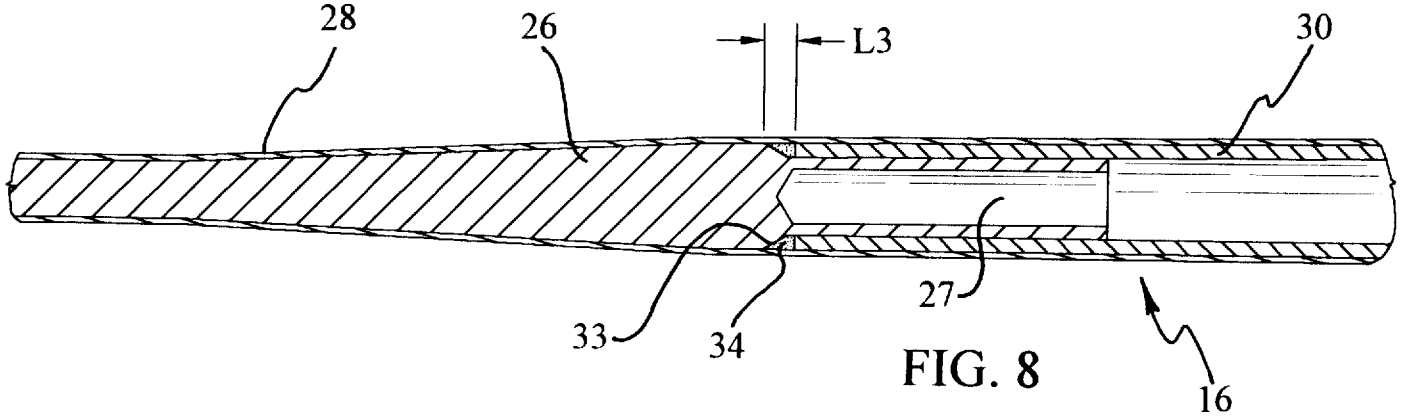
FIG. 8 is a partial cross-sectional view of the golf club of the present invention in the transitional region of the shaft, taken along a plane defined by the Z and Y axes of FIG. 1.

FIG. 8 is a partial cross-sectional view of the shaft 16 in the transitional region, taken along a plane defined by the Z and Y axes of FIG. 1. Beginning at the transitional region of the shaft 16 (L1+L2 from the hosel 22, FIG. 2) and extending to the tip of the shaft 16, the outer-most surfaces of the spar 26 most nearly parallel to the X axis contact the interior surface of the skin 28. A filler material 34 may be required to fill the void created by the end of the tube 30, the interior surface of the skin 28, and a tapered annular surface 33 of the spar 26. The length of this void along the shaft 16 is designated by L3, which may range between 0 and 30 mm. The filler material has a density ($\rho_2$) less than 8.0 kg/dm$^3$.

Referring to FIG. 7, the length L4 defines the mating region of the tube 30 onto the spar 26, ranging between 20 and 75 mm. L4 also defines the length of the primary structural joint between the spar 26, skin 28, and tube 30. The length L5 defines the portion of the spar 26 with a circular cross-section, ranging between 20 and 130 mm. This portion preferably embodies the cavity 27 in order to reduce weight. A secondary purpose of the cavity 27 is for piloting of the temporary mandrel prior to filament winding of the tube 30, if the tube 30 is to be filament wound.

Figure 9:
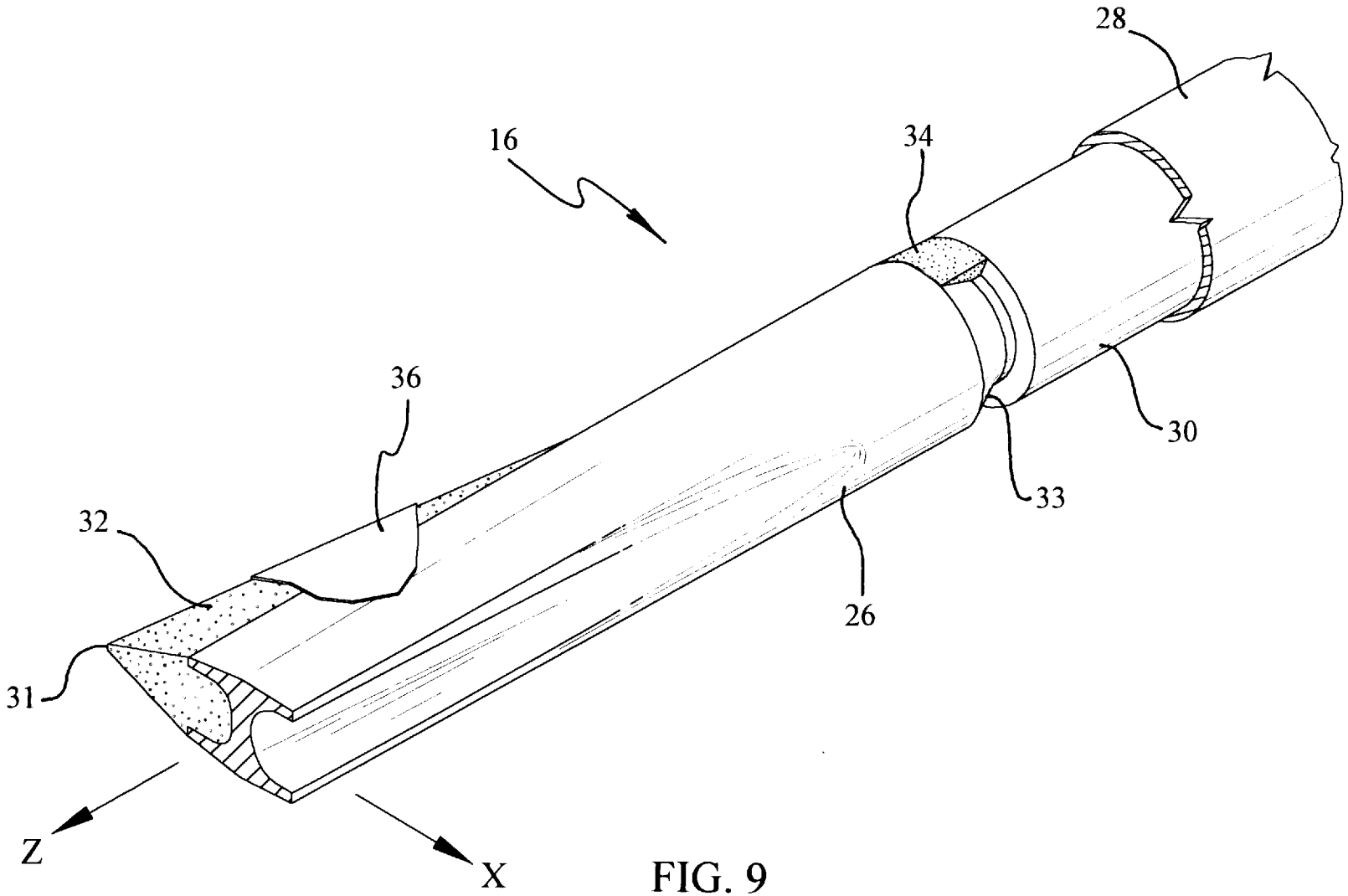
FIG. 9 is a partly sectional, perspective view of the golf club of the present invention in the transitional region of the shaft.

A partly sectional, perspective view of the transitional region of the shaft 16 is depicted in FIG. 9. The skin 28 is partially removed from the shaft 16 exposing the spar 26, core 32, tube 30, filler material 34, and a thin film 36. The portion of the core 32 opposite the trailing edge 31 ( the leading edge portion) of the streamlined shaft 16 is not shown in order to illustrate the transitional shape of the spar 26. The filler material 34 is partially removed in order to illustrate the void created by the tapered annular surface 33 of the spar 26 and the end of the tube 30. The thin film 36, described in greater detail later, is partially removed from the spar 26 and core 32 for clarity.

The preferred embodiment of the golf club 10 of the present invention may use a blend of high and low modulus composite materials and metallic materials. It is necessary to have a high value for the longitudinal Young's modulus of the spar 26 in order for it to restore bending properties about the X axis of the shaft 16. One material candidate for the spar 26 is uni-axial filament aligned graphite/epoxy composite, such as Goodyear GY-70 graphite with Shell Epon 828 epoxy binder. The filaments are aligned in the Z direction of the shaft 16. This composite exhibits an extremely high modulus of 275 Gpa, at the expense of ultimate tensile strength. An alternate graphite material could be Union Carbide's Thornell P55S, which with a modulus of 235 Gpa, is nearly as high as that of GY-70 for a markedly lower price. Alternate epoxy resins could be those possessing high adhesion strength, such as Dow DER 331, Ciba Giegy 604, and Union Carbide 2774.

The preferred method of manufacture of the spar 26 is to press uni-axially orientated filaments and resin binder into near net shape, using dies under high pressure. This part would then be cured, removed from the dies, and machined to length. It is preferred that the recessed surfaces 23 of the spar 26 be formed to net shape. Excess material would be orientated in the areas which will later be machined away, forming the surfaces of the spar 26 contacting the skin 28. Due to the faceted nature of the streamlined region of the shaft 16, complex machining of the surfaces of the spar 26 is minimized. An alternate method of manufacturing the spar 26 is to machine from solid composite bar stock. This method is less desirable due to the anticipated operation time. If it is impractical to manufacture the spar 26 by the above methods, the spar 26 may be made from an alternate homogeneous material.

Alternate material candidates for the spar 26 could be titanium or steel, with Young's modulus equal to 107 GPa and 200 GPa respectively. Both would offer lower modulus and increased weight over some graphite composites, however, forming the spar 26 from these materials may offer an advantage over composites. The spar 26 constructed from these materials could be forged, cast, or powder sintered to near net shape, requiring little or no post-machining. The density ($\rho$) of these alternate materials does tend to more readily limit the practical length of the streamlined section of the shaft 16.

The tube 30 is preferably constructed in a conventional filament winding process, whereby fibers pre-impregnated with a resin binder are wrapped around a temporary cylindrical mandrel at a predetermined angle. The material for the tube 30 would preferably be a high modulus composite, such as the graphite/epoxy candidates previously described. In lieu of a composite material, the tube 30 could be constructed from drawn metallic tubing, such as steel or titanium. At the expense of increased weight, the use of a metallic tube 30 could offer the advantage of reduced manufacturing time by eliminating the necessity for a temporary mandrel, since the tube 30 would not be filament wound. Additionally, it may be easier to join the tube 30 to the spar 26 by brazing, welding, swaging, or fastening.

The skin 28 may also be constructed in a conventional filament winding process, however, as opposed to the tube 30 which may use a temporary mandrel during filament winding, the skin 28 would be constructed by wrapping a fibrous resin impregnated material at a predetermined angle directly over the spar 26, tube 30, core 32, filler material 34, and thin film 36. The material for the skin 28 would preferably be a lower modulus composite, such as S-glass/epoxy, in order to minimize its contribution to shaft stiffness about the Y axis in the fully streamlined region. It may not be necessary to filament wind material forming the skin 28 along the entire length of the shaft 16. However, filamentary material forming the skin 28 should at least be wrapped from the tip of the shaft 16 to a distance along the shaft 16 at which the spar 26 is cylindrical in cross-section, in order to create the previously mentioned structural joint. The skin 28 has a nearly constant wall thickness for simplicity, however, the wrap angle of the filaments forming the skin 28 may vary from the cylindrical portion to the streamlined portion of the shaft 16.

An alternate method of manufacturing the skin 28 would be to injection mold two plastic halves which are mirrored copies of each other. These halves would then be bonded to the spar 26 and core 32 using a structural adhesive.

The material utilized for the core 32 would preferably be a foam, such as polystyrene or Styrofoam™. The foam would ideally be molded around the spar 26 in order to minimize final shaping. An alternate material which could be employed is balsa wood. The disadvantage with using this material would be the increased work required to shape the core 32. The core in the vicinity of the streamlined skin has a density ($\rho_1$) less than 2.0 kg/dm$^3$.

During filament winding of the skin 28, a high level of pressure may be exerted on the relatively sharp trailing edge 31 of the streamlined region of the shaft 16. This might cause the filament tow to dig into the core 32 instead of laying on the surface. Therefor, it may be necessary to apply the previously mentioned thin film 36 over the exterior of the streamlined portion of the shaft 16 prior to filament winding of the skin 28, thereby increasing the bearing strength of the core 32. This film 36 may take the form of a spray or dipped epoxy-like coating, a heat-shrunk plastic such as that used to insulate electrical wiring, or an adhesive backed plastic such as Mylar™.

If the previously mentioned films do not provide adequate core 32 bearing strength for filament winding, a temporary core 32 may be affixed to the spar 26. This temporary core 32 could be in the form of a hard wax. Once filament winding of the skin 28 is complete, the temporary core 32 could be removed by raising its melting temperature during the curing of the skin 28, or subsequent to this step. A permanent foam core 32 could then be injected into the cavities of the shaft 16, or if the skin 28 possesses sufficient transverse compressive strength, omitted entirely.

The spar 26, skin 28, and core 32 each possess a unique longitudinal Young's modulus. Further, each of these components possesses a unique moment of inertia about the X and Y axes for each location along the shaft 16. For clarity, Ix represents the sectional moment of inertia of a component about the X axis, Iy represents the sectional moment of inertia of a component about the Y axis, E represents a component's longitudinal Young's modulus, and EIx or EIy represent a component's product of E and Ix or Iy about the X and Y axes respectively. The core 32 is intended to have a very low Young's modulus ($E_3$), and thus contribute little to bending properties of the shaft 16. It will be ignored in the subsequent discussion, however, in reality the contribution of the core 32 will be included in designing the shaft 16.

In order to provide equal shaft bending properties at each position along the Z axis, the shaft 16 is designed such that; the skin's sectional value EIx added with the spar's sectional value EIx, must nearly equal; the skin's sectional value of EIy added with the spar's sectional value EIy.

To produce the previously described equality, the spar 26 is carefully designed such that its cross-sectional shape embodies the proper value of Ix and Iy at each cross-section along the Z axis of the shaft 16. This is especially true in the transitional region where the cross-sectional shape of the shaft 16 is changing most rapidly. The above equality is a general rule which must be satisfied. However, subtle contributions to the bending properties of the shaft 16, such as adhesion between components, may require experimental testing in order to optimize each component.

A typical graphite/epoxy golf club shaft has a diameter of 8.51 mm at the tip, and a wall of 1.93 mm. These dimensions produce moment of inertia properties of 2.331 E-10 m$^4$.

Testing of this shaft for bending, and Finite Element Analysis (FEA) of a discrete model of the same, derive an effective longitudinal Young's modulus of 34.47 GPa. This longitudinal Young's modulus is understood to be the modulus along the length of the shaft, independent of the orientation that can be given to the fibers. Thus, the conventional shaft tested has a value for the product of moment of inertia and modulus (EIx and EIy) equal to 8.03 N-M$^2$ at the tip. This value is taken as a lower limit for the summation of EIx and EIy for the present invention at the tip of the shaft 16.

Table 1 lists the sectional properties at the tip of the shaft 16 for a streamlined shaft of the present invention, and at the tip for the aforementioned conventional shaft. This table demonstrates the manner in which the spar 26 and skin 28 of the present invention function together to produce equal bending about X and Y axes. The streamlined section is that of the preferred embodiment, as shown in FIG. 6*a*, with the spar 26 constructed of the previously described GY-70 graphite/epoxy, and the skin 28 constructed of a low modulus S-glass/epoxy.

TABLE 1

| Description | Streamlined | Round |
|---|---|---|
| Section width along X axis (mm) | 15.24 | 8.51 |
| Section height along Y axis (mm) | 5.33 | 8.51 |
| Skin moment of inertia, $Ix_1$ ($m^4$) | 4.961E-11 | 2.331E-10 |
| Skin moment of inertia, $Iy_1$ ($m^4$) | 2.727E-10 | 2.331E-10 |
| Skin Young's modulus, $E_1$ (GPa) | 13.79 | 34.47 |
| Skin wall Thickness (mm) | 0.46 | 1.93 |
| Spar moment of inertia, $Ix_2$ ($m^4$) | 2.890E-11 | NA |
| Spar moment of inertia, $Iy_2$ ($m^4$) | 1.773E-11 | NA |
| Spar Young's modulus, $E_2$ (GPa) | 275.79 | NA |
| $E_1IX_1 + E_2Ix_2$ (N-m$^2$) | 8.65 | 8.03 |
| $E_1Iy_1 + E_2Iy_2$ (N-m$^2$) | 8.65 | 8.03 |

The golf club 10 of the present invention has a shaft 16 with increased wetted surface area over conventional shafts. The previously described streamlined shape reduces form drag but may increase skin friction drag, which is primarily a function of wetted area and skin roughness. A method of reducing the skin friction drag may be employed whereby the exterior surface of the shaft 16 comprises a random pattern of small bumps. These bumps are chevron or V shaped in appearance and are typically less than a millimeter in length. The bumps reduce drag by re-energizing the boundary layer next to the surface of the skin 28. Reductions of skin friction drag of up to 12% may be possible using this method. It is envisioned that these bumps would be molded into the shaft 16 during or after the curing of the filament wound skin 28.

The shaft 16 so prepared may be incorporated into the golf club 10 by wrapping or otherwise covering the grip end of the shaft 16 with a suitable grip material such as leather or rubber, and affixing a clubhead 12 to the tip end of the shaft 16 by applying a suitable adhesive and inserting the tip end of the shaft 16 into the hosel 22 of the clubhead 12.

It is expressly stated that the aforementioned related prior art do not serve to teach or disclose the present invention. In addition, all materials and manufacturing methods referenced as suitable candidates for the present invention do not serve to teach or disclose the present invention. The invention is not limited to the above preferred embodiments and various modifications thereof may be made without departing from the spirit and scope of the invention. Rather, the scope of the invention is defined by the appended claims.

What is claimed is:

1. A golf club shaft comprising;

a spar orientated such that its greater dimension is aligned with said longitudinal axis (Z axis) of said shaft, said spar provided with a means of producing greater stiffness about an axis generally aligned with a direction of swing (X axis) than about an axis generally perpendicular to the direction of swing (Y axis), said spar being constructed from a material having a Young's modulus about said longitudinal axis (Z axis) greater than 100 Gpa;

a skin orientated such that its greater dimension is aligned with said longitudinal axis (Z axis) of said shaft, said skin being demarcated by an exterior surface, an interior surface, a tip end adapted to be affixed to a clubhead, said skin having a streamline cross-sectional shape at said tip end, said streamline shape having a first dimension along an axis generally aligned with the direction of swing (X axis), a second dimension along an axis generally perpendicular to the direction of swing (Y axis), said second dimension being less than said first dimension;

wherein said skin and said spar are combined such that a longitudinal Young's modulus ($E_1$) of said skin multiplied by a sectional moment of inertia about an axis generally aligned with the direction of swing ($I_{X1}$) of said skin, and summed with, a longitudinal Young's modulus ($E_2$) of said spar multiplied by a sectional moment of inertia about an axis generally aligned with the direction of swing ($I_{X2}$) of said spar, is substantially equal to, the longitudinal Young's modulus ($E_1$) of said skin multiplied by a sectional moment of inertia about an axis generally perpendicular to the directions of swing ($I_{Y1}$) of said skin, and summed with, a longitudinal Young's modulus ($E_2$) of said spar multiplied by a sectional moment of inertia about an axis generally perpendicular to the direction of swing ($I_{Y2}$) of said spar; and wherein said shaft at each position along said longitudinal axis (Z axis) has a bending characteristic about the axis generally aligned with the direction of swing (X axis) and a bending characteristic about the axis generally perpendicular to the directions of swing (Y axis) such that the bending characteristic about the axis generally aligned with the direction of swing (X axis) and the bending characteristic about the axis generally perpendicular to the directions of swing (Y axis) are substantially equalized.

2. A golf shaft according to claim 1, further comprising an elongated tube orientated such that its greater dimension is aligned with the longitudinal axis (Z axis) of said shaft, said tube having a circular cross-section, said tube being demarcated by an exterior surface, an interior surface, a butt end adapted to be affixed to a grip, and an end adapted to be affixed to said spar.

3. A golf club shaft according to claim 2, wherein said tube is formed by filament winding a fibrous material impregnated with a resin binder at a predetermined angle.

4. A golf club shaft according to claim 2, wherein said tube is formed from metallic tubing.

5. A golf club shaft according to claim 2, wherein said spar has a tapered annular surface in a vicinity of the end of said tube.

6. A golf club shaft according to claim 5, wherein a filler material having a density ($\rho_2$) less than 8.0 kg/dm$^3$ is affixed to said tapered annular surface.

7. A golf club shaft according to claim 2, wherein said skin has a first thickness (T1) and said tube has a second thickness (T2) which is greater than said first thickness.

8. A golf club shaft according to claim 1, further comprising a core in a vicinity of said streamline skin having a density ($\rho_1$) less than 2.0 kg/dm$^3$, said core being demarcated into a minimum of two portions by said spar, a first portion bounded by said interior surface of said skin forming a leading edge of said shaft, and a second portion bounded by said interior surface of said skin forming a trailing edge of said shaft.

9. A golf club shaft according to claim 1, wherein said spar is demarcated by at least two portions along the longitudinal axis of said shaft, a first portion having a circular cross-section, a second portion having an I-beam like cross-section, said circular portion having equal moments of inertia about axes generally aligned with and perpendicular to the swing direction (X and Y axes), and said I-beam portion having a greater moment of inertia about the axis generally aligned with the direction of swing (X axis) than about the axis generally perpendicular to the direction of swing (Y axis).

10. A golf club shaft according to claim 9, wherein said circular portion of said spar comprises a cavity, said cavity being circular in cross-section.

11. A golf club shaft according to claim 1, wherein said skin is formed by filament winding a fibrous material impregnated with a resin binder at a predetermined angle.

12. A golf club shaft according to claim 1, wherein the exterior of said skin comprises a random pattern of chevron shaped bumps so that said shaft produces lower skin friction drag.

13. A method of manufacturing a golf club shaft having a spar orientated such that its greater dimension is aligned with said longitudinal axis (Z axis) of said shaft, said spar provided with a means of producing greater stiffness about an axis generally aligned with a direction of swing (X axis) than about an axis generally perpendicular to the direction of swing (Y axis), said spar being constructed from a material having a Young's modulus about said longitudinal axis (Z axis) greater than 100 Gpa;

a skin orientated such that its greater dimension is aligned with said longitudinal axis (Z axis) of said shaft, said skin being demarcated by an exterior surface, an interior surface, a tip end adapted to be affixed to a clubhead, said skin having a streamline cross-sectional shape at said tip end, said streamline shape having a first dimension along an axis generally aligned with the direction of swing (X axis), a second dimension along an axis generally perpendicular to the direction of swing (Y axis), said second dimension being less than said first dimension;

wherein said skin and said spar are combined such that a longitudinal Young's modulus ($E_1$) of said skin multiplied by a sectional moment of inertia about an axis generally aligned with the direction of swing ($I_{X1}$) of said skin, and summed with, a longitudinal Young's modulus ($E_2$) of said spar multiplied by a sectional moment of inertia about an axis generally aligned with the direction of swing ($I_{X2}$) of said spar, is substantially equal to, the longitudinal Young's modulus ($E_1$) of said skin multiplied by a sectional moment of inertia about an axis generally perpendicular to the directions of swing ($I_{Y1}$) of said skin, and summed with, a longitudinal Young's modulus ($E_2$) of said spar multiplied by a sectional moment of inertia about an axis generally perpendicular to the direction of swing ($I_{Y2}$) of said spar;

an elongated tube orientated such that its greater dimension is aligned with the longitudinal axis (Z axis) of said shaft, said tube having a circular cross-section, said tube being demarcated by an exterior surface, an interior surface, a butt end adapted to be affixed to a grip, and an end adapted to be affixed to said spar;

wherein said shaft at each position along said longitudinal axis (Z axis) has a bending characteristic about the axis generally aligned with the direction of swing (X axis) and a bending characteristic about the axis generally perpendicular to the directions of swing (Y axis) such that the bending characteristic about the axis generally aligned with the direction of swing (X axis) and the bending characteristic about the axis generally perpendicular to the directions of swing (Y axis) are substantially equalized comprising steps;

a step of forming said spar;

a step of filament winding a fibrous material impregnated with a resin binder at a predetermined angle over a temporary mandrel and over a circular cross-sectional end of said spar to form said tube;

a step of affixing a temporary core to said spar;

a step of filament winding a fibrous material impregnated with a resin binder at a predetermined angle over said tube, said spar, and said core to form said skin;

a step of curing said tube and said skin;

a step of removing said temporary core; and a step of removing said temporary mandrel from within said tube.

14. A method of manufacturing a golf club shaft having a spar orientated such that its greater dimension is aligned with said longitudinal axis (Z axis) of said shaft, said spar provided with a means of producing greater stiffness about an axis generally aligned with a direction of swing (X axis) than about an axis generally perpendicular to the direction of swing (Y axis), said spar being constructed from a material having a Young's modulus about said longitudinal axis (Z axis) greater than 100 Gpa;

a skin orientated such that its greater dimension is aligned with said longitudinal axis (Z axis) of said shaft, said skin being demarcated by an exterior surface, an interior surface, a tip end adapted to be affixed to a clubhead, said skin having a streamline cross-sectional shape at said tip end, said streamline shape having a first dimension along an axis generally aligned with the direction of swing (X axis), a second dimension along an axis generally perpendicular to the direction of swing (Y axis), said second dimension being less than said first dimension;

wherein said skin and said spar are combined such that a longitudinal Young's modulus ($E_1$) of said skin multiplied by a sectional moment of inertia about an axis generally aligned with the direction of swing ($I_{X1}$) of said skin, and summed with, a longitudinal Young's modulus ($E_2$) of said spar multiplied by a sectional moment of inertia about an axis generally aligned with the direction of swing ($I_{X2}$) of said spar, is substantially equal to, the longitudinal Young's modulus ($E_1$) of said skin multiplied by a sectional moment of inertia about an axis generally perpendicular to the directions of swing ($I_{Y1}$) of said skin, and summed with, a longitudinal Young's modulus ($E_2$) of said spar multiplied by a sectional moment of inertia about an axis generally perpendicular to the direction of swing ($I_{Y2}$) of said spar;

an elongated tube orientated such that its greater dimension is aligned with the longitudinal axis (Z axis) of said shaft, said tube having a circular cross-section, said tube being demarcated by an exterior surface, an interior surface, a butt end adapted to be affixed to a grip, and an end adapted to be affixed to said spar;

wherein said shaft at each position along said longitudinal axis (Z axis) has a bending characteristic about the axis generally aligned with the direction of swing (X axis) and a bending characteristic about the axis generally perpendicular to the directions of swing (Y axis) such that the bending characteristic about the axis generally aligned with the direction of swing (X axis) and the bending characteristic about the axis generally perpendicular to the directions of swing (Y axis) are substantially equalized comprising steps;

a step of forming said spar;

a step of forming said tube;

a step of affixing said tube to said spar;

a step of affixing a temporary core to said spar;

a step of filament winding a fibrous material impregnated with a resin binder at a predetermined angle over said tube, said spar, and said core to form said skin;

a step of curing said skin; and a step of removing said temporary core.

15. A method of manufacturing a golf club shaft having a spar orientated such that its greater dimension is aligned with said longitudinal axis (Z axis) of said shaft, said spar provided with a means of producing greater stiffness about an axis generally aligned with a direction of swing (X axis) than about an axis generally perpendicular to the direction of swing (Y axis), said spar being constructed from a material having a Young's modulus about said longitudinal axis (Z axis) greater than 100 Gpa;

a skin orientated such that its greater dimension is aligned with said longitudinal axis (Z axis) of said shaft, said skin being demarcated by an exterior surface, an interior surface, a tip end adapted to be affixed to a clubhead, said skin having a streamline cross-sectional shape at said tip end, said streamline shape having a first dimension along an axis generally aligned with the direction of swing (X axis), a second dimension along an axis generally perpendicular to the direction of swing (Y axis), said second dimension being less than said first dimension;

wherein said skin and said spar are combined such that a longitudinal Young's modulus ($E_1$) of said skin multiplied by a sectional moment of inertia about an axis generally aligned with the direction of swing ($I_{X1}$) of said skin, and summed with, a longitudinal Young's modulus ($E_2$) of said spar multiplied by a sectional moment of inertia about an axis generally aligned with the direction of swing ($I_{X2}$) of said spar, is substantially equal to, the longitudinal Young's modulus ($E_1$) of said skin multiplied by a sectional moment of inertia about an axis generally perpendicular to the directions of swing ($I_{Y1}$) of said skin, and summed with, a longitudinal Young's modulus ($E_2$) of said spar multiplied by a sectional moment of inertia about an axis generally perpendicular to the direction of swing ($I_{Y2}$) of said spar;

an elongated tube orientated such that its greater dimension is aligned with the longitudinal axis (Z axis) of said shaft, said tube having a circular cross-section, said tube being demarcated by an exterior surface, an interior surface, a butt end adapted to be affixed to a grip, and an end adapted to be affixed to said spar;

a core in a vicinity of said streamline skin having a density ($\rho_1$) less than 2.0 kg/dm$^3$, said core being demarcated into a minimum of two portions by said spar, a first portion bounded by said interior surface of said skin forming a leading edge of said shaft, and a second portion bounded by said interior surface of said skin forming a trailing edge of said shaft;

wherein said shaft at each position along said longitudinal axis (Z axis) has a bending characteristic about the axis generally aligned with the direction of swing (X axis) and a bending characteristic about the axis generally perpendicular to the directions of swing (Y axis) such that the bending characteristic about the axis generally aligned with the direction of swing (X axis) and the bending characteristic about the axis generally perpendicular to the directions of swing (Y axis) are substantially equalized comprising steps;

a step of forming said spar;

a step of filament winding a fibrous material impregnated with a resin binder at a predetermined angle over a temporary mandrel and over a circular cross-sectional end of said spar to form said tube;

a step of affixing said core to said spar;

a step of filament winding a fibrous material impregnated with a resin binder at a predetermined angle over said tube, said spar, and said core to form said skin;

a step of curing said tube and said skin; and a step of removing said temporary mandrel from within said tube.

16. A method of manufacturing a golf club shaft having a spar orientated such that its greater dimension is aligned with said longitudinal axis (Z axis) of said shaft, said spar provided with a means of producing greater stiffness about an axis generally aligned with a direction of swing (X axis) than about an axis generally perpendicular to the direction of swing (Y axis), said spar being constructed from a material having a Young's modulus about said longitudinal axis (Z axis) greater than 100 Gpa;

a skin orientated such that its greater dimension is aligned with said longitudinal axis (Z axis) of said shaft, said skin being demarcated by an exterior surface, an interior surface, a tip end adapted to be affixed to a clubhead, said skin having a streamline cross-sectional shape at said tip end, said streamline shape having a first dimension along an axis generally aligned with the direction of swing (X axis), a second dimension along an axis generally perpendicular to the direction of swing (Y axis), said second dimension being less than said first dimension;

wherein said skin and said spar are combined such that a longitudinal Young's modulus ($E_1$) of said skin multiplied by a sectional moment of inertia about an axis generally aligned with the direction of swing ($I_{X1}$) of said skin, and summed with, a longitudinal Young's modulus ($E_2$) of said spar multiplied by a sectional moment of inertia about an axis generally aligned with the direction of swing ($I_{X2}$) of said spar, is substantially equal to, the longitudinal Young's modulus ($E_1$) of said skin multiplied by a sectional moment of inertia about an axis generally perpendicular to the directions of swing ($I_{Y1}$) of said skin, and summed with, a longitudinal Young's modulus ($E_2$) of said spar multiplied by a sectional moment of inertia about an axis generally perpendicular to the direction of swing ($I_{Y2}$) of said spar;

an elongated tube orientated such that its greater dimension is aligned with the longitudinal axis (Z axis) of said shaft, said tube having a circular cross-section, said tube being demarcated by an exterior surface, an interior surface, a butt end adapted to be affixed to a grip, and an end adapted to be affixed to said spar;

a core in a vicinity of said streamline skin having a density ($\rho_1$) less than 2.0 kg/dm$^3$, said core being demarcated into a minimum of two portions by said spar, a first portion bounded by said interior surface of said skin forming a leading edge of said shaft, and a second portion bounded by said interior surface of said skin forming a trailing edge of said shaft;

wherein said shaft at each position along said longitudinal axis (Z axis) has a bending characteristic about the axis generally aligned with the direction of swing (X axis) and a bending characteristic about the axis generally perpendicular to the directions of swing (Y axis) such that the bending characteristic about the axis generally aligned with the direction of swing (X axis) and the bending characteristic about the axis generally perpendicular to the directions of swing (Y axis) are substantially equalized comprising steps;

a step of forming said spar;

a step of forming said tube;

a step of affixing said tube to said spar;

a step of affixing said core to said spar;

a step of filament winding a fibrous material impregnated with a resin binder at a predetermined angle over said tube, said spar, and said core to form said skin; and a step of curing said skin.

* * * * *